US005692908A

United States Patent [19]

Fehlmann et al.

[11] Patent Number: 5,692,908

[45] Date of Patent: Dec. 2, 1997

[54] APPARATUS FOR ELECTRICALLY CONNECTING TWO ELECTRICAL CONNECTING CONDUCTORS TO AN ELECTRICAL DEVICE

[75] Inventors: Wolfgang Fehlmann, Stuttgart; Wolfgang Braun, Ditzingen; Markus Nieslony, Salach, all of Germany

[73] Assignee: Robert Bosch GmbH, Stuttgart, Germany

[21] Appl. No.: 549,801

[22] PCT Filed: Mar. 9, 1995

[86] PCT No.: PCT/DE95/00327

§ 371 Date: Nov. 17, 1995

§ 102(e) Date: Nov. 17, 1995

[87] PCT Pub. No.: WO95/26058

PCT Pub. Date: Sep. 28, 1995

[30] Foreign Application Priority Data

Mar. 19, 1994 [DE] Germany ..... 44 09 544.9

[51] Int. Cl.[6] ..... H01R 13/621

[52] U.S. Cl. ..... 439/11; 439/364

[58] Field of Search ..... 439/22, 27, 11, 439/12, 13, 20, 21, 362, 364

[56] References Cited

U.S. PATENT DOCUMENTS

| | | | |
|---|---|---|---|
| 2,645,759 | 7/1953 | Solari | 439/22 |
| 4,061,381 | 12/1977 | Smal | 439/22 |
| 5,114,352 | 5/1992 | Gahagen et al. | 439/22 |

*Primary Examiner*—Gary F. Paumen

*Attorney, Agent, or Firm*—Edwin E. Greigg; Ronald E. Greigg

[57] ABSTRACT

An apparatus for connecting two electrical connecting conductors to an electrical device, in which the ends of the connecting conductors are injection molded into a connection piece and connected to connection contacts which are secured onto a securing pin in a manner lying one behind the other and coaxially isolated by an insulating piece and, by means of a screwing part, the connection contacts, make contact with connection elements which are likewise mutually electrically isolated by means of an insulating part. In order to secure any desired rotational position, the connection piece has a peripheral toothing of the electrical device. This permits space-saving production, which is amenable to assembly, of an electrical connection between connecting conductor and electrical device, it being possible to bring the external connecting conductors into a desired position with little outlay.

17 Claims, 2 Drawing Sheets

APPARATUS FOR ELECTRICALLY CONNECTING TWO ELECTRICAL CONNECTING CONDUCTORS TO AN ELECTRICAL DEVICE

PRIOR ART

The invention is based on an apparatus connecting two electrical connecting conductors to an electrical connection. In the case of an apparatus for the electrical connection of two electrical connecting conductors disclosed by DE-A1-42 03 133, two connection pins provided with a screw thread are provided on the electrical device to be connected. The connecting conductors each lead into a connection molding having an elongated eye, the center line of which follows a circular path. The connection moldings are situated opposite one another in such a way that the eyes are diametrically opposite one another, referring to a geometrical center point between the connection pins. The connection moldings are held together by a web in such a way that the moldings having an extension piece following the connecting conductor are parallel to one another. In order to produce the connection, the eyes of the moldings are slipped over the connection pins, it being possible to alter the angle at which the connecting conductors extend with respect to the electrical device in the context of the length of the eyes, and a fixed contact with the electrical device being produced thereafter by fixing using securing screws. Such a device can be used to produce small changes in position of the connecting conductors with respect to the electrical device. The intention here is to be able to keep the line lengths shorter.

In addition to the disadvantage that two connection pins have to be present, to each of which the connecting conductors have to be fixed separately, the known device also has the disadvantage that, nevertheless, it is possible to change the position of the connecting conductors only in a narrowly limited scope, this being due to the possibilities of providing eyes in the form of part-circle recesses. The result is a high assembly outlay.

Advantages of the Invention

In contrast, the apparatus has the advantage that the connecting conductors can lead away from the electrical device in any desired angular position in a radial plane adjoining the securing pin. In this case, only a single securing pin is advantageously provided.

In an advantageous development, the selected angular positions can be reliably maintained by positive locking. In this case, a corresponding fine subdivision of the recurring forms of the positive locking surfaces enables a precise alignment of the connecting conductors to the electrical device to be produced in very small angular increments. At the same time that the connection piece carrying the connecting conductors is secured, the contact is also effected in a simple manner. In this case, a large contact-making area is provided and reliable mutual electrical isolation of the connecting conductors is achieved. In a readily manageable manner, the connection contacts and the ends of the connecting conductors are fixed in a manner encapsulated within the connection piece, access to the live parts and the screwing parts being prevented, accordance with the aid of a stopper after the connection piece has been fixed and after contact has been made between the connecting conductors and the electrical connections of the device. This results in a reliable encapsulation of the voltage-carrying parts to protect against external influences and, given appropriate safeguarding of the stopper, also in protection against unauthorized access. Overall, the apparatus has the advantage that the connection of the connecting conductors to the electrical device can be carried out with the aid of automatic assembly machines. Furthermore, the essential advantage results that, in the case of device parts that are located around the electrical connection and would hinder cable routing, an optimum point for feeding the connecting conductors can be found with the aid of the angular adjustment of the position of said connecting conductors. This results in a space-saving arrangement which also reduces the length of the connecting conductors. Such connections are also suitable, in particular, for the harsh operation in a motor vehicle, for example in the production of an electrical connection to a solenoid valve in a fuel injection pump.

DESCRIPTION OF THE EXEMPLARY EMBODIMENT

Figure 1:
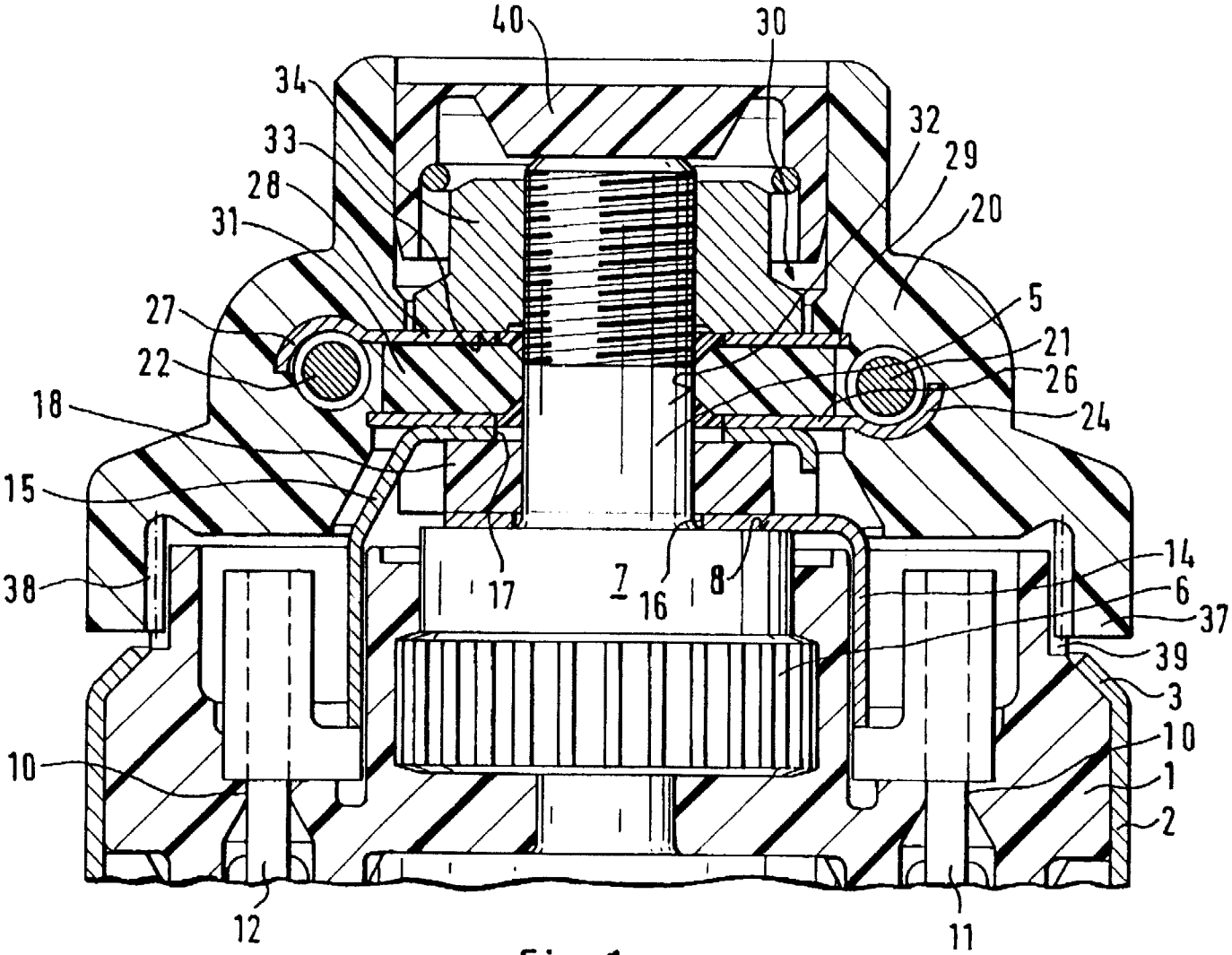
FIG. 1 illustrates a partial cross sectional view of an electrical connection having two electrical wires connected to a connecting device.

FIG. 1 portrays a section through the apparatus according to the invention. Provided on one end of an electrical device, for example a solenoid valve, is a closure part 1, which closes off the solenoid valve housing 2, the edge 3 of which is flanged onto a shoulder of the closure part, with the result that the latter is held in a fixed manner in the solenoid valve housing. A securing pin 5 with a base 6 having an anchoring profile on its peripheral surface is injection molded into this closure part made of insulating material, said base 6 having a very large diameter and being adjoined by a cylindrical part 7 which has a smaller diameter and partially projects outwards at the end from the encapsulation of the closure part. This cylindrical part forms an axially directed shoulder 8 which is fixed to the housing and merges with the securing pin 5, which is provided with an external thread at the end. Furthermore, one connection 11, 12 each, for example of the solenoid of the solenoid valve, is routed axially to the outside through the closure part in holes 10, one connection 11 of which makes contact by means of a clamped or welded joint with a first connection element 14 and the other connection 12 makes contact correspondingly with a second connection element 15. These connection elements have an annular design and are pushed by their inner hole 16 and 17, respectively, over the securing pin. In this case, the first connection element 14 bears directly on the shoulder 8 as a planar ring. This is then followed by an annular intermediate piece 18 made of insulating material and then by the annular part of the second connection element 15, which comes to bear on the annular intermediate piece at the end and is kept at a radial distance from the securing pin by stops (not shown in any more detail).

In order to connect the connections 11 and 12 to the power supply, a connection piece 20 is further provided, into which are injection molded the ends of a first connecting conductor 21 and of a second connecting conductor 22. A first contact-making extension 24 of a first connection contact 26 and a second contact-making extension 27 of a second connection contact 28 are also injection molded. The contact-making extensions protrude from an annular part of the respective connection contact, it likewise being possible to injection mold the outer edges 29 of these annular parts into the connection piece as well. The annular parts project, within two adjacent radial planes, into an axial recess 30 in the connection piece and are isolated from one another by an insulating part 31. The latter is guided by its radially inwardly pointing end face 32 on the securing pin and serves at the same time as a first guide of the connection element 20 on the securing pin 5. The internal diameter of the annular parts of the connection contacts 26 and 28 is greater than the diameter of the securing pin and the internal diameter of the end face 32 of the insulating part, this ensuring that the connection contacts do not come into contact with the securing pin 5, which is produced from electrically conductive material.

The first connection contact together with the second connection contact are firstly brought to bear on the second connection element 15 by a screwing part 34 which is axially screwed onto the securing pin and, in the example shown, is a nut made of electrically conductive material, as a result of which, in turn, the first connection element 14 is brought to bear permanently and in a contact-making manner on the shoulder 8. For this purpose, the screwing part has an end 33 which ends up on the second connection contact 28 and can be grooved for the purpose of better contact-making and also for the purpose of self-locking. Consequently, the second connecting conductor 22 is connected to the connection 11 via the second connection contact 28, the screwing part 34, the securing pin 5 and the first connection element 14, and the first connecting conductor 21 is connected to the connection 12 via the extension 24, the first connection contact 26 and the second connection element 15. The first and second connection contacts 26, 28 are spaced from the pin by insulation of element 31 which projects between the pin and the first and second connection contact 26, 28.

The connection part 20 further has a wall 37, which is in the form of an annular sleeve that engages over the closure part and has on its inside positive locking surfaces with a profile 38 extending in the axial direction of the securing pin. This profile may be a toothing having edges pointing in the peripheral direction, which toothing engages into a corresponding mating toothing 39 on the outer periphery of the closure part. By means of these positive locking surfaces 38 and 39 with a profile having a uniform progression in the peripheral direction, the connection piece can now be placed onto the closure part with very fine subdivision into different rotational positions and, consequently, be fixed in a specific desired rotational position in the peripheral direction of rotation. After this placement, the screwing part 34 is then screwed on, since the connection contacts and connection elements were threaded in place during the placement operation of the connection piece. After the connection piece has been fixed by screwing with the screwing part 34, the axial recess can additionally be closed off by a stopper 40, which can be pressed, bonded or screwed into the recess. In this way, the outgoing connecting conductors can be led away in any desired angular position with respect to the solenoid valve housing. The two connecting conductors make contact in a simple manner with the connections of the solenoid valve by means of a simple screwing operation after the placement of the connection piece, and this considerably simplifies the assembly and also permits automatic assembly.

Figure 2:
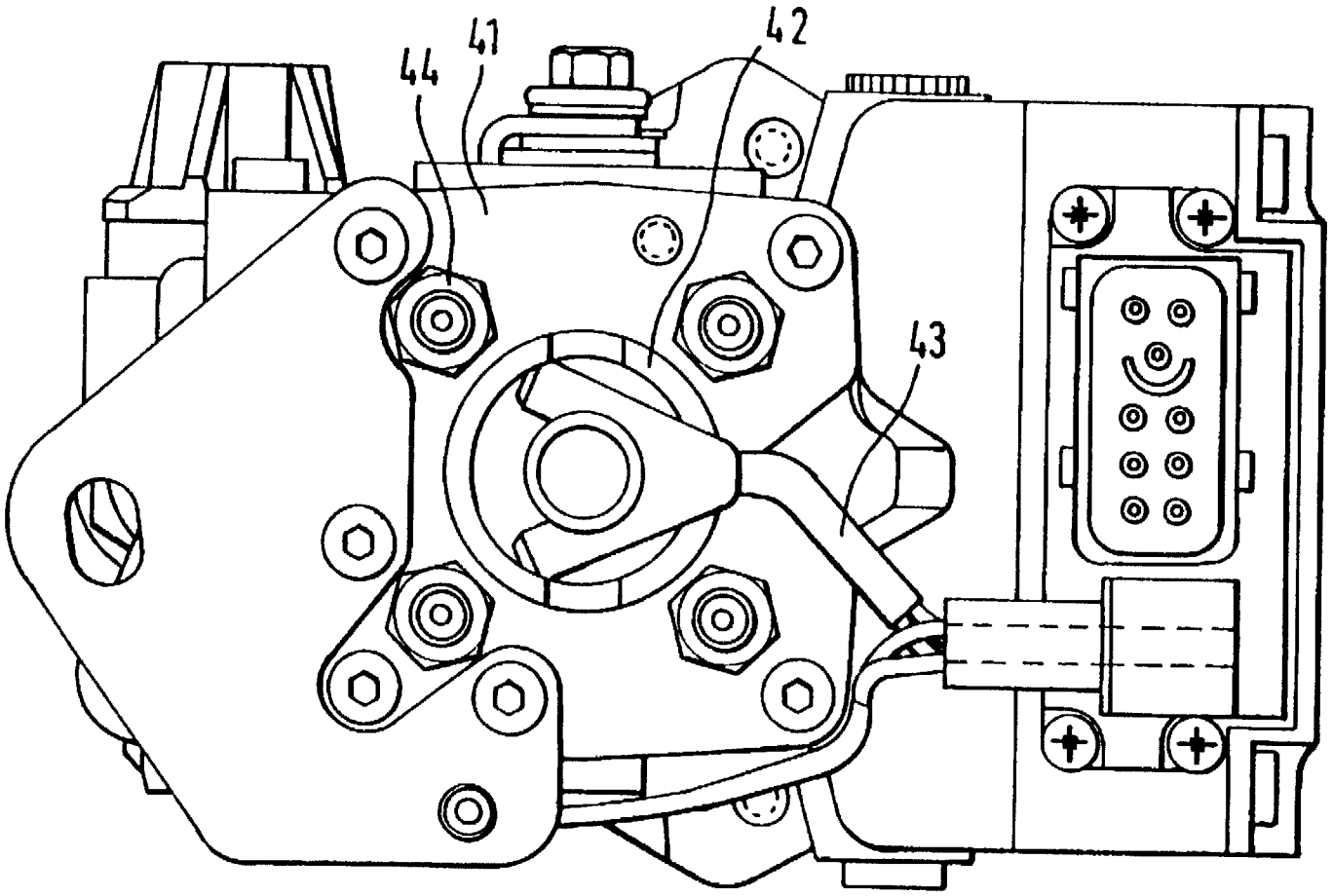
FIG. 2 illustrates a plan view of a connection piece connected to a solenoid.

FIG. 2 illustrates a plan view of the connection piece 20 screwed onto a distributor injection pump 41 with a solenoid valve 42. The V-shaped conjoining of the connecting conductors to form a jointly sheathed cable 43, which leads away between injection lines 44, is evident here.

The foregoing relates to preferred exemplary embodiments of the invention, it being understood that other variants and embodiments thereof are possible within the spirit and scope of the invention, the latter being defined by the appended claims.

We claim:

1. An apparatus for electrically connecting first and second electrical conductors (21, 22) as part of a connection piece (20) to first and second electrical connections (11, 12) of an electrical device (1, 2), the first and second electrical connections (11, 12) are connected respectively to first and second connection elements (14, 15) in which the first and second connection elements (14, 15) extend to an outside of the electrical device, said first and second connection elements of the electrical device have outer ends arranged coaxially and one behind the other and separated from one another by an insulating part (31), an electrically conductive securing pin (5) is anchored in an insulating manner on the electrical device, said securing pin guides the outer ends of said first and second connection elements and said insulating part and, by a force locking means makes electrical contact, with said outer end of said first connection element with a part of said electrically conductive securing pin and said outer end of said second connection element being insulated against said securing pin, respective first and second connection contacts (26, 28) are fixed in said connection piece (20), each of said first and second connection contacts have one end that makes contact with respective said first and second connecting conductors (21, 22) which extend out of the connection piece (20) and one of said first and second connection contacts have another end which is in force locking electrical contact to said outer end of one of said first and second connection elements, and the other of said first and second connection contacts have another end which is in force locking electrical contact with the other of said first and second connection elements via said securing pin.

2. The apparatus as claimed in claim 1, wherein the connection piece (20) is coupled, via a multiplicity of positive locking first surfaces (38), to corresponding positive locking second surfaces (39) of the housing (2) in a manner rotationally fixed thereto, the first and second positive locking surfaces extending in a direction of an elongated axis of the securing pin (5) and are provided in a multiple recurring form in a peripheral direction with respect to the axis, in such a way that the connection piece (20) can be rearranged in small angular increments in a peripheral direction.

3. The apparatus as claimed in claim 2, wherein, for the purpose of producing a contact, the connection piece (20) has an axially outwardly pointing shoulder on which a screwing part (34), which is screwed onto the securing pin, comes to bear, thereby producing an electrically conductive connection to the securing pin.

4. The apparatus as claimed in claim 3, wherein the shoulder is formed by the second connection contact (28), which is axially isolated from the first connection contact (26) by said insulating part (31) guided on the securing pin (5), said first contact (26), in turn, comes to bear as a shoulder on the second connection element (15).

5. The apparatus as claimed in claim 4, wherein the first and second connection element (14, 15) are electrically isolated from one another by means of an annular, insulating intermediate piece (18), which is guided on the securing pin (5), the first connection element (14) bears on a shoulder (8) which is connected to the securing pin (5) and is fixed to the housing, and the screwing part (34) is formed of an electrically conducting material.

6. The apparatus as claimed in claim 4, wherein the first and second connection contacts (26, 28) and the first and second connection elements (14, 15) form annular contact surfaces which surround the securing pin.

7. The apparatus as claimed in claim 5, wherein the first and second connection contacts (26, 28) and the first and second connection elements (14, 15) form annular contact surfaces which surround the securing pin.

8. The apparatus as claimed in claim 6, wherein the connection contacts (26, 28) are injection molded into the connection piece, formed from insulating material, with contact-making extensions (24, 27) which are undetachably connected to the ends, which are likewise injection molded, of the connecting conductors (21, 22).

9. The apparatus as claimed in claim 7, wherein the connection contacts (26, 28) are injection molded into the connection piece, formed from insulating material, with contact-making extensions (24, 27) which are undetachably connected to the ends, which are likewise injection molded, of the connecting conductors (21, 22).

10. The apparatus as claimed in claim 8, wherein the contact-making extensions (24, 27) have a fluted design in the region of their connection to the connecting conductors (21, 22).

11. The apparatus as claimed in claim 9, wherein the contact-making extensions (24, 27) have a fluted design in the region of their connection to the connecting conductors (21, 22).

12. The apparatus as claimed in claim 3, wherein the connection piece (20) has an axial passage opening (30), which is closed off on the side of the screwing element (34) by means of a stopper (40) after production of the electrical connection.

13. The apparatus as claimed in claim 5, wherein the connection piece (20) has an axial passage opening (30), which is closed off on the side of the screwing element (34) by means of a stopper (40) after production of the electrical connection.

14. The apparatus as claimed in claim 5, wherein the connection piece (20) has an axial passage opening (30), which is closed off on the side of the screwing element (34) by means of a stopper (40) after production of the electrical connection.

15. The apparatus as claimed in claim 6, wherein the connection piece (20) has an axial passage opening (30), which is closed off on the side of the screwing element (34) by means of a stopper (40) after production of the electrical connection.

16. The apparatus as claimed in claim 8, wherein the connection piece (20) has an axial passage opening (30), which is closed off on the side of the screwing element (34) by means of a stopper (40) after production of the electrical connection.

17. The apparatus as claimed in claim 10, wherein the connection piece (20) has an axial passage opening (30), which is closed off on the side of the screwing element (34) by means of a stopper (40) after production of the electrical connention.

* * * * *